United States Patent [19]

Spenceley et al.

[11] 4,093,452

[45] June 6, 1978

[54] REFINING LIQUID METAL

[75] Inventors: Gene Donald Spenceley, Penistone, near Sheffield; Neil Pigott, Rotherham, both of England

[73] Assignee: British Steel Corporation, London, England

[21] Appl. No.: 707,060

[22] Filed: Jul. 20, 1976

[30] Foreign Application Priority Data

Jul. 23, 1975 United Kingdom ..... 30841/75

[51] Int. Cl.[2] ..... C21C 7/00; C21C 7/06

[52] U.S. Cl. ..... 75/53; 75/58; 75/60; 75/93 R; 75/129

[58] Field of Search ..... 75/51–60, 75/68, 129, 93, 61

[56] References Cited

U.S. PATENT DOCUMENTS

| | | | |
|---|---|---|---|
| 3,574,596 | 4/1971 | Lohman | 75/51 |
| 3,737,303 | 6/1973 | Blayden | 75/68 R |
| 3,741,751 | 6/1973 | Bone | 75/68 R |
| 3,771,998 | 11/1973 | Knuppel | 75/60 |

*Primary Examiner*—P. D. Rosenberg
*Attorney, Agent, or Firm*—Bacon & Thomas

[57] ABSTRACT

A method and apparatus for treating a bath of liquid iron or steel by submerged injection of a gas or gas-entrained particulate re-agents. Injection is through a tuyere occludable either by a stopper rod assembly or by a sliding gate valve and the bath treatment may include desulphurizing, deoxidizing, alloying or sulphide modifying.

10 Claims, 2 Drawing Figures

REFINING LIQUID METAL

Figure 1:
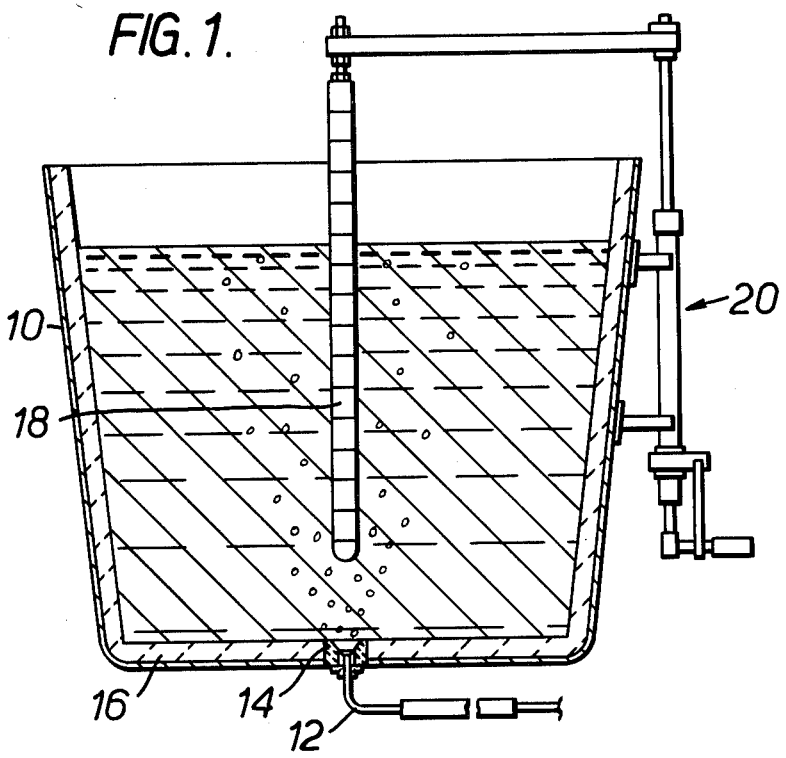

This invention relates to the treatment of liquid metal in a container and particularly, but not exclusively, relates to the treatment of iron or steel.

In the treatment of liquid metals it is customary to add solic reagent material to the metal bath from overhead. For example, blast furnace hot metal may be treated with a desulphurising reagent applied to the liquid metal in the blast furnace runner, in the transfer ladle or in the torpedo vessel. Also liquid steel may be treated with a deoxidising reagent introduced into the liquid metal in a ladle intermediate the primary refining vessel such as a basic oxygen furnace and the casting station. Liquid steel may also be treated with alloying reagents introduced to the metal in the ladle.

These various processes can tend to be unsatisfactory in that the methods of addition of the reagent materials and the conditions for solution and mixing of the reagent may not be optimum. For example, the addition of reagent whether for desulphurising, deoxidising or alloying is frequently via an overhead shute and on to the surface of the liquid metal bath which is frequently covered with slag, or alternatively, the reagent materials are entrained in a suitable carrier gas and introduced via a lance immersed through the upper surface of the bath. Where reagents are added to the surface, effective mixing and contact with all parts of the bath cannot be guaranteed. When reagents are injected, reliability and consistency of operation is a problem because of factors such as lance wear and breakage.

It is an object of the present invention to provide an improved method and apparatus for the treatment of liquid metal which will obviate at least some of the disadvantages of presently known methods.

In accordance with one aspect of the invention there is provided a method of treating a bath of liquid metal in a container comprising the step of introducing a gas into the bath through an occludable tuyere in the container wall or base. A particulate reagent material may conveniently be entrained with the gas.

Also in accordance with the invention there is provided apparatus for treating liquid metal comprising a container for a bath of liquid metal and an occludable tuyere in the container wall or base for permitting introduction of a gas into the bath.

The tuyere may be occludable by a stopper rod device for occluding a nozzle in the container to which the tuyere is connected or the tuyere may form part of a sliding gate valve assembly.

The reagent material may comprise a desulphurant such as, for example, lime, calcium carbide, sodium carbonate, magnesium, magnesium oxide, calcium silicide, calcium cyanamide, calcium metal, calcium silicon or mischmetal; a deoxidant and/or alloying agent such as, for example, carbon, ferrosilicon, ferromanganese, ferroniobium, ferrovanadium, ferrochromium, ferroboron, aluminum, calcium silicide or calcium silicomanganese; or sulphide modifiers such as, for example, mischmetal, calcium and calcium containing components. Similarly, the reagent material may comprise a mixture of such individual materials.

The entraining gas for the reagent material may comprise for example, air, nitrogen, argon, carbon monoxide, carbon dioxide, natural gas or other hydrocarbons, or mixtures thereof.

It will be appreciated that one or more occludable tuyeres may be provided in the container for admitting gas entrained particulate reagent material to the liquid metal bath. In the case of a tuyere which is occludable by a stopper rod it may be convenient for the tuyere to be located in the base of the container and for the contents of the container to be discharged over the lip by tilting the container.

In the case of a tuyere associated with a sliding gate valve assembly, the sliding gate proper may include a discharge spout and/or a porous plug as well as means for occluding the tuyere and the nozzle in the container itself. The purpose of the porous plug would be to keep the nozzle entry clear from metal skulls and to homogenise the bath contents.

Figure 2:
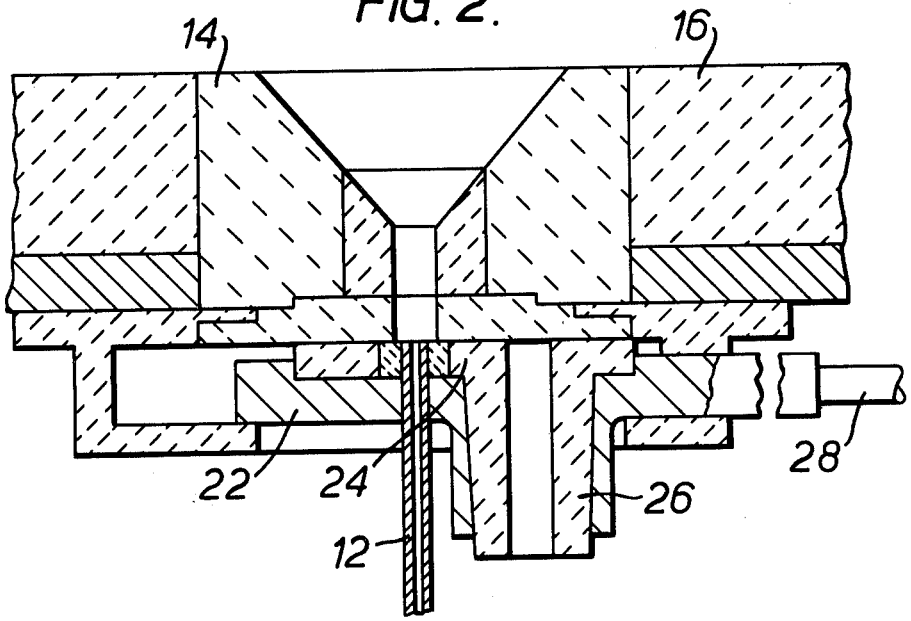

Other features of the invention will become apparent from the following description given herein solely by way of example with reference to the accompanying drawings wherein;

FIG. 1 is a side cross-sectional view of a container for liquid metal having a single tuyere in its base occludable by a conventional refractory stopper rod and, FIG. 2 is a cross-sectional view through a sliding gate valve assembly having a tuyere associated therewith for the introduction of gas entrained reagent material to a container to which a valve is fitted.

In the illustration of FIG. 1 there is shown a container 10 for liquid metal which may conveniently comprise a transfer ladle for blast furnace hot metal, which in accordance with the invention is to be desulphurised by the introduction of a gas entrained particulate desulphurising reagent through an occludable tuyere 12. The tuyere 12 is inset into a refractory nozzle 14 which is itself located within the refractory lining 16 of the ladle in the base thereof. The upper portion of the refractory nozzle 14 is flared to co-operate with a conventional stopper rod 18 having a domed lower end and actuated for movement in a vertical plane by conventional operating means 20 external of the ladle 10.

When it is desired to introduce the desulphurising reagent into the liquid metal the stopper rod 18 is lifted off the nozzle 14 and desulphurising reagent in particulate form is blown through the tuyere 12 and nozzle 14 by a pressurized carrier gas into the bath to be discharged and mixed therein by the gas bubbles as they rise to the surface of the bath. After an appropriate period of treatment the stopper rod 18 is lowered to occlude the nozzle 14 at which time the supply of desulphurant and entraining carrier gas may be shut off. The hot metal will then usually remain in the ladle for an appropriate period of time for the desulphurising slag to separate after which the metal may be discharged over the lip of the ladle by tilting into, for example, a basic oxygen furnace. The desulphurant slag may be skimmed prior to pouring or may be held back during the pouring operation.

In FIG. 2 of the drawings there is illustrated an alternative means for occluding the tuyere 12 which comprises a sliding gate valve assembly 22 situated below the refractory nozzle 14 which is located in the refractory lining 16 of the ladle; the tuyere 12 being inset into the refractory material of the sliding gate. In this embodiment the sliding gate is actuated by a fluid pressure device acting on the rod 28 to move in a horizontal plane between three positions in a first of which the tuyere 12 is in alignment with the nozzle, 14, a second position in which the nozzle 14 is closed by a part 24 of the refractory of the sliding gate and a third position in which the discharge spout 26 is in alignment with the nozzle 14. As a further embodiment, the closed position may incorporate a porous plug through which a gas may be passed if required.

When utilising such an assembly the ladle would be filled with hot metal with the nozzle closed and the sliding gate would then be moved to the position shown in FIG. 2 at which time the desulphurant entrained in the carrier gas under pressure would be blown into the hot metal through the tuyere 12 and nozzle 14. After an appropriate period of time the sliding gate would be moved to the left with reference to FIG. 2 to close the nozzle by the part 24 and the supply of desulphurant and carrier gas would be shut off. Finally after a further appropriate period to allow for the desulphurising slag to separate from the metal the sliding gate would be moved to the extreme left with reference to FIG. 2 bringing the discharge spout 26 into alignment with the nozzle 14 for transfer of the liquid metal to, for example, a basic oxygen furnace.

In a further embodiment of the invention, the tuyere through which the particulate material is added may be of a design other than a cylindrical tube. In some circumstances, in order to prevent molten metal runback down the tuyere and attain satisfactory tuyere life, it may be desirable to surround the tube which carries the particulate material, by an annulus through which a fluid is passed. This protective fluid may be reactive or inert and comprise, for example, argon, air, nitrogen, natural gas or other gaseous or liquid hydrocarbons, carbon monoxide, carbon dioxide or mixtures thereof. Other tuyere configurations can be envisaged to give flexibility of operation, e.g. multiple concentric or coaxial tuyeres.

It will be appreciated that the method and apparatus in accordance with this invention may be utilised for treating any liquid metal in a container and offers the advantage of the introduction of reagent material directly into the liquid metal for promoting the efficiency of mixing and reaction.

We claim:

1. A method of treating a molten metal in a transfer container having a top, a base and a discharge nozzle in the base, said nozzle having, on the exterior of the container, a sliding gate valve assembly for controlling the discharge of metal from the nozzle and the introduction of reagent material entrained within a gas directly into the molten metal to promote the efficiency of mixing and reaction, said valve assembly comprising a discharge spout, a gas inlet pipe and a closure portion, said spout, pipe and closure portion being selectively movable into alignment with the discharge nozzle of the container, which comprises introducing the molten metal through the top of the transfer container while the nozzle of said container is stopped by the gate valve, moving said gate valve and introducing through the inlet pipe a particulate re-agent material entrained within a gas to promote efficient mixing and reacting of the re-agent with the molten metal and then removing the treated molten metal through the sliding gate valve.

2. A method as claimed in claim 1 wherein the closure portion of the sliding gate valve assembly includes a porous plug to permit the entrance of agitating gas into said container and introducing an agitating gas into the batch through the porous plug to facilitate the mixing and reaction of the added re-agent.

3. A method as claimed in claim 1 wherein the re-agent material comprises a desulphurising material.

4. A method as claimed in claim 3 wherein the desulphurising material is lime, calcium carbide, sodium carbonate, magnesium, magnesium oxide, calcium silicide, calcium cyanamide, calcium metal, calcium silicon, mischmetal, or mixtures thereof.

5. A method as claimed in claim 1 wherein the re-agent material is a deoxidant, an alloying agent or mixtures thereof.

6. A method as claimed in claim 5 wherein the deoxidant or alloying agent is aluminium, calcium silicide, calcium silicomanganese, ferrosilicon, ferromanganese, ferroniobium, ferrovanadium, ferrochromium, ferroboron, carbon, or mixtures thereof.

7. A method as claimed in claim 1 wherein the re-agent material comprises a sulphide modifier.

8. A method as claimed in claim 7 wherein the sulphide modifier is mischmetal, calcium, calcium containing component or mixtures thereof.

9. A method as claimed in claim 1 wherein the gas is air, nitrogen, argon, carbon monoxide, carbon dioxide, natural gas, other hydrocarbons or mixtures thereof.

10. A method as claimed in claim 1 wherein the liquid metal is a ferrous metal.

* * * * *